US011904255B1

(12) United States Patent
Nanda

(10) Patent No.: US 11,904,255 B1
(45) Date of Patent: Feb. 20, 2024

(54) MAGIC TRICK APPARATUS AND METHODS THEREOF

(71) Applicant: Penguin Magic, Inc., Rancho Cordova, CA (US)

(72) Inventor: Rizki Nanda, Tebing Tinggi (ID)

(73) Assignee: Penguin Magic, Inc., Rancho Cordova, CA (US)

( * ) Notice: Subject to any disclaimer, the term of this patent is extended or adjusted under 35 U.S.C. 154(b) by 0 days.

(21) Appl. No.: 18/212,509

(22) Filed: Jun. 21, 2023

(51) Int. Cl.
*A63J 21/00* (2006.01)

(52) U.S. Cl.
CPC ..... *A63J 21/00* (2013.01)

(58) Field of Classification Search
CPC ..... A63J 25/00; A63J 99/00; A63J 2005/002; A63J 5/00; A63J 5/02; A63J 1/028; A63J 3/00; A63J 7/00; A63J 21/00
See application file for complete search history.

(56) References Cited

U.S. PATENT DOCUMENTS 4,288,072 A * 9/1981 Gewirtz ..... A63J 21/00 472/69
5,549,515 A * 8/1996 Kondo ..... A63J 21/00 472/63
9,821,244 B1 * 11/2017 Whang ..... A63H 33/046
10,960,321 B1 * 3/2021 Kranzo ..... A63J 21/00

* cited by examiner

*Primary Examiner* — Sisay Yacob
(74) *Attorney, Agent, or Firm* — POLSINELLI PC

(57) ABSTRACT

A magic trick apparatus and methods of use is described. The magic trick apparatus may include a half sphere having a rounded side and a flat surface with a coin attached to the flat surface of the half sphere. The magic trick apparatus may further include a band and a ridge on the rounded side and a hole extending into the half sphere. The magic trick apparatus may be used to "transform" a coin into a lollipop.

24 Claims, 6 Drawing Sheets

MAGIC TRICK APPARATUS AND METHODS THEREOF

FIELD

The present disclosure relates generally to a magic trick apparatus and methods for performing a magic trick using the magic trick apparatus. In at least one example, the present disclosure relates to magic trick apparatuses and methods to perform a transformation of a coin to a lollipop, or vice versa.

BACKGROUND

Magicians have devised magic tricks to make audiences perceive intended illusions for amusement and wonder. To implement magic tricks in close proximity, the magicians use various articles and devices that may include everyday items, such as coins and cards. However, magicians are constantly looking for new, simple, and quick tricks that may be easily learned and portable.

As presented herein, a magic trick apparatus has been developed to help magicians easily perform a transformation of a coin to a lollipop, or vice versa.

BRIEF SUMMARY

Provided herein is a magic trick apparatus operable to allow a magician to perform a transformation of a coin into a lollipop. The magic trick apparatus may include a half sphere having a rounded side and a flat surface. In some aspects, the magic trick apparatus may have a coin attached to the flat surface. In an aspect, the coin may be a US quarter, a US half dollar, a US nickel, a foreign currency coin, a chip, a token, or a coin with no assigned value. In some aspects, the magic trick apparatus may have a hole extending into the rounded side of the half sphere located proximal the flat surface. In an aspect, the hole may have a diameter of about 2 mm to about 5 mm and be operable to hold a stick. In another aspect, the rounded side may have a band located along a center axis of the rounded side and projecting out from a surface of the rounded side. In another aspect, the magic trick apparatus may have a ridge projecting out from the rounded side and surrounding a circumference of the half sphere proximal the flat surface. In an additional aspect, the magic trick apparatus may be made of a hard plastic such as acrylic, polycarbonate, or polyethylene.

Further provided herein is a magic trick kit operable to allow a magician to transform a coin into a lollipop. In an aspect, the magic trick kit may include a magic trick apparatus. In additional aspects, the magic trick kit may include a lollipop having a candy end and a stick. In some aspects, the magic trick kit may include a container operable to hold a magic trick apparatus and a lollipop. In some aspects, the magic trick apparatus may further include a band projecting from the rounded side. In another aspect, the magic trick apparatus may include a ridge surrounding a circumference or the half sphere proximal the flat surface. In a further aspect, the magic trick kit may include a loose coin. In another aspect, the lollipop may be a fake lollipop. In a further aspect, the lollipop may be wrapped in a wrapper.

Further provided herein is a method of transforming a coin into a lollipop. In some aspects, the method may include providing a magic trick apparatus. The magic trick apparatus may include a half sphere having a rounded side and a flat surface. The magic trick apparatus may further include a coin attached to the flat surface of the half sphere.

In some aspects, the method may include showing an observer only the coin attached to the flat surface of the half sphere, concealing a candy end of a lollipop, inserting a stick of the lollipop in a hole at an edge of the rounded side proximal the flat surface of the magic trick apparatus, and rotating the magic trick apparatus 180 degrees to show the observer the rounded side of the half sphere. In an aspect, the method may further include concealing the magic trick apparatus and removing the stick from the hole of the magic trick apparatus. In another aspect, the method may include providing the lollipop to the observer. In a further aspect, the half sphere may have a band projecting from the rounded side along a center axis and a ridge projecting from the rounded side along a circumference of the rounded side. In some aspects, prior to showing the observer the coin attached to the flat surface of the half sphere, the method may include showing an observer a loose coin identical to the coin attached to the flat surface of the half sphere and then concealing the loose coin. In a further aspect, the method may include rotating the magic trick apparatus to the rounded side before inserting the stick of the lollipop into the hole of the magic trick apparatus. In another aspect, the lollipop may be given away to the observer. In another aspect, the lollipop may be wrapped in a wrapper. In a further aspect, the method may include having the observer unwrap the lollipop.

Other aspects and iterations of the invention are described more thoroughly below.

BRIEF DESCRIPTION OF THE DRAWINGS

Implementations of the present technology will now be described, by way of example only, with reference to the attached figures, wherein.

DETAILED DESCRIPTION

Figure 1:
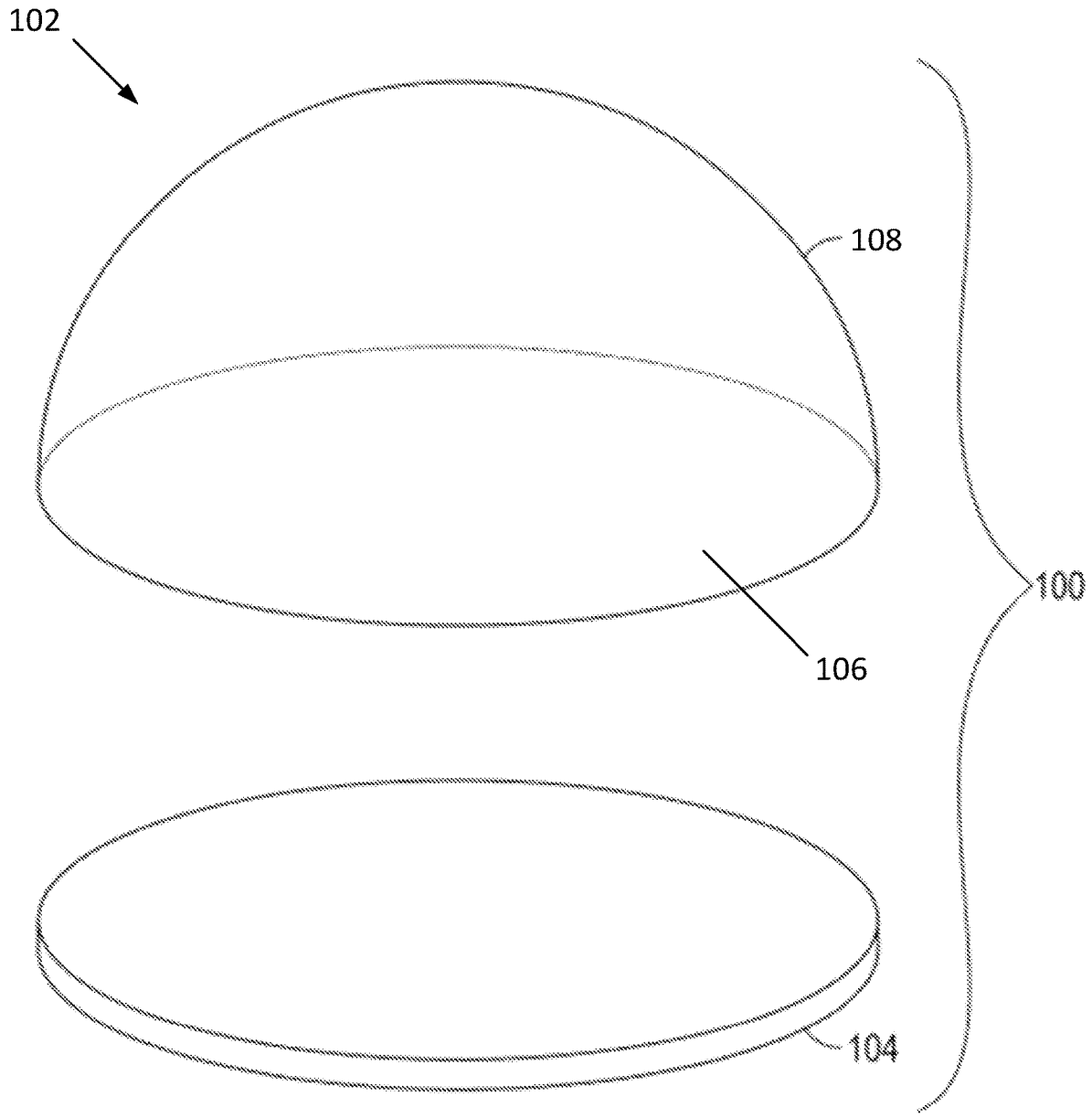
FIG. 1 shows an exploded view of the magic trick apparatus in one example.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, "substantially cylindrical" means that the object resembles a cylinder, but can have one or more deviations from a true cylinder.

The terms "comprising," "including" and "having" are used interchangeably in this disclosure. The terms "comprising," "including" and "having" mean to include, but not necessarily be limited to the things so described.

For purposes of this description, "connected to" or "attached to" includes two components being directly connected or indirectly connected with intervening components.

The magic trick apparatus is a unique and novel apparatus to transform a coin into a lollipop. The magic trick apparatus is a half sphere, i.e. hemisphere, with a coin connected to the flat surface, such that it may present to an observer as only a coin when viewed from one side and only a lollipop when viewed from an opposite side. In this way, the magician may easily "transform" the coin into the lollipop, or vice versa. In addition, the magic trick apparatus may be paired with a complete lollipop that looks similar or identical to the half sphere for inspection by the observer. The complete lollipop may be given to an observer upon completion of the magic trick.

Referring to FIG. 1, the magic trick apparatus 100 includes a half sphere 102 and a coin 104 attached to the flat surface 106 of the half sphere 102. The half sphere 102 may appear to be a hemisphere of a complete lollipop. In some examples, the half sphere 102 may have the same size, shape, and color of a hemisphere of a complete lollipop.

Figure 2:
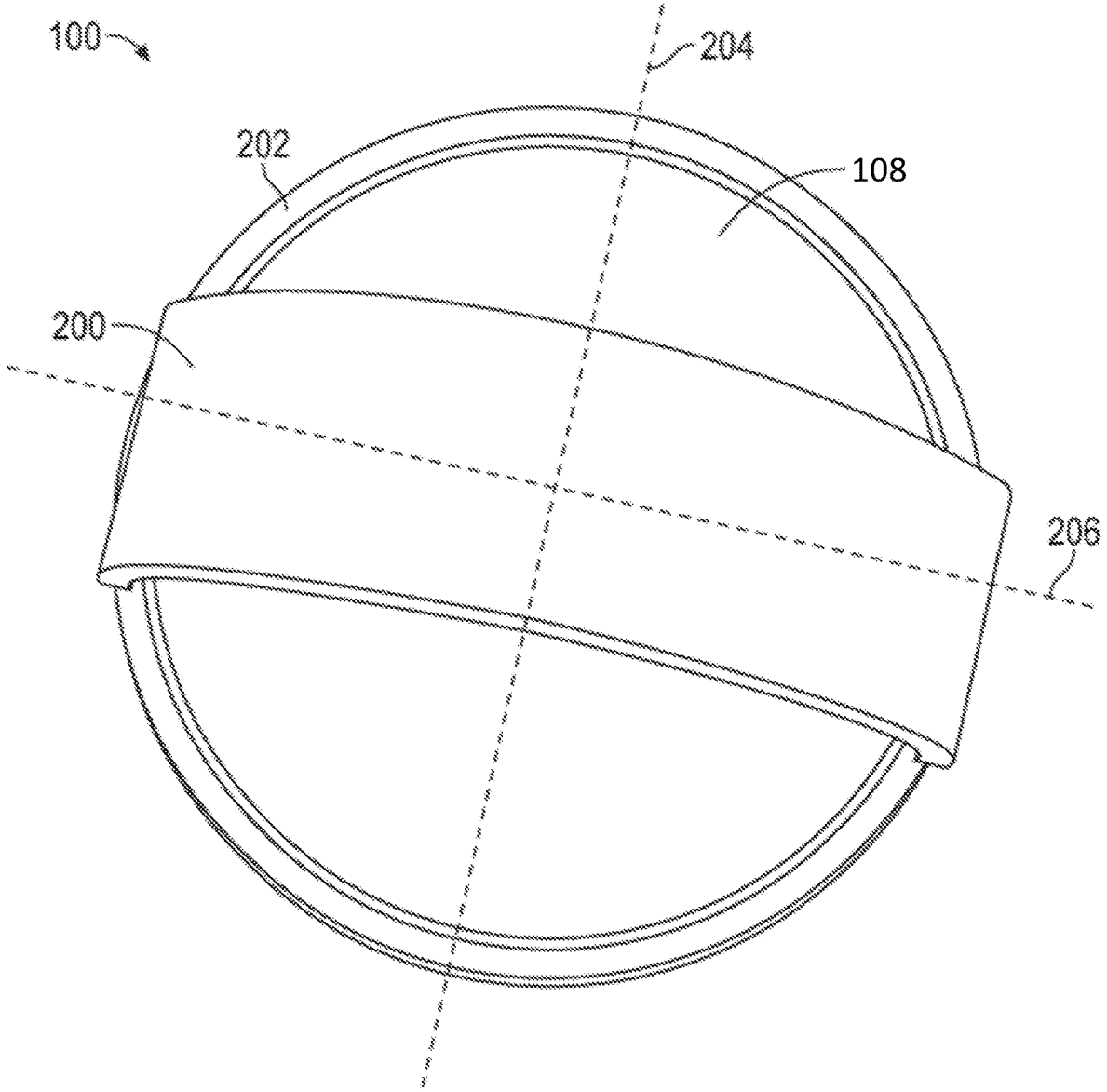
FIG. 2 shows a top view of a magic trick apparatus in one example.

In an embodiment, the rounded side 108 of the half sphere 102 may be completely round with no projections, as illustrated, for example, in FIG. 1. As illustrated in FIG. 2, the half sphere 102 may have a band 200 projecting out from the rounded side 108 of the half sphere 102. The band 200 may extend from one edge of the rounded side 108 to an opposite edge of the rounded side 108 along a first axis 206 (e.g., a center axis running through the center of the half sphere). In some examples, the band 200 have a width of about 1 millimeter (mm), about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, or more. The band 200 may project out about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, or more from the rounded side 108 of the half sphere 102.

Figure 3:
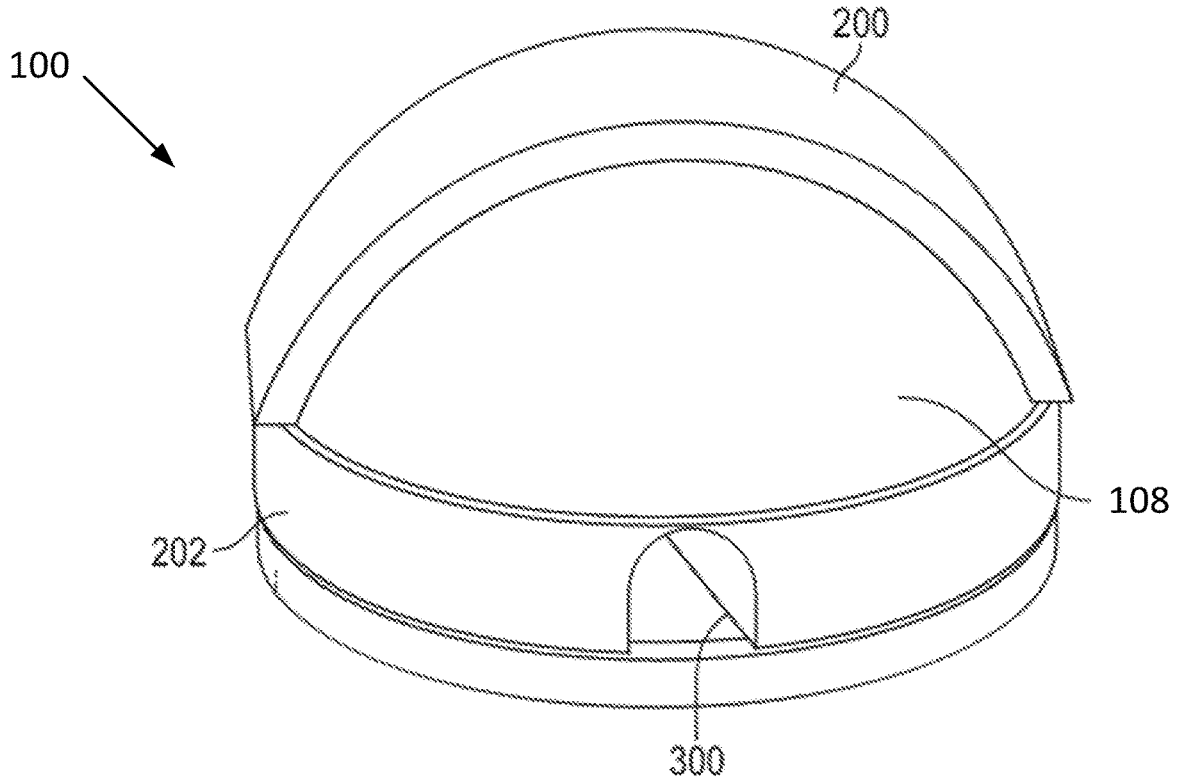
FIG. 3 shows a side view of a magic trick apparatus in one example.

As illustrated in FIGS. 2 and 3, the magic trick apparatus 100 may have a ridge 202 proximal to the flat surface 106 of the half sphere 102. The ridge may wrap around the circumference of the rounded side 108 proximal to the flat surface 106. The ridge 202 may project out from the rounded side 108 about 0.25 mm, about 0.5 mm, about mm, about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, or more. In an example, the ridge 202 may project less than 1 mm out from the rounded side 108 of the half sphere 102. In another example, the ridge 202 may project out from the rounded side 108 of the half sphere 102 about 0.5 mm. The ridge 202 may have a width of about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, or more. In an example, the ridge 202 may have a width of less than 1 mm. In another example, the ridge may have a width of about 2 mm.

In some embodiments, the rounded side 108 of the half sphere 102 may have a band 200 but not have a ridge 202. In other embodiments, the rounded side 108 of the half sphere 102 may have a ridge 202 but not have a band 200. In further embodiments, the rounded side 108 of the half sphere 102 may not have a band 200 or a ridge 202 and be substantially round. In another embodiment, the rounded side 108 of the half sphere 102 may have a band 200 and a ridge 202. The half sphere 102 may be configured to appear to be any type of lollipop, sucker, or candy on a stick.

As illustrated in FIG. 3, the magic trick apparatus 100 may further include a hole 300. In an example, the hole 300 may be near an edge of the rounded side 108 of the half sphere 102 proximal the flat surface 106. The hole 300 may extend into the half sphere 102. The hole 300 may be operable to receive a cylindrical object. As illustrated in FIG. 3, the hole 300 may be located in the ridge 202 along the second axis 204 (e.g., perpendicular to the first axis 206 and the band 200). When the hole 300 is located along the second axis 204, a magician may be able to easily locate the hole 300 by locating the band 200. When the magician locates the band 200, the magician knows that the hole is located 90 degrees from a center point of the band 200 (e.g., the point of the band 200 at a maximum height from the flat surface 106). In other examples, the hole 300 may be located at any point along the ridge 202. In further examples, if the magic trick apparatus 100 does not have a ridge 202, the hole 300 may be located at any point proximal to the flat surface 106 of the half sphere 102.

In an embodiment, the hole 300 may have a diameter of about 1 mm, about 1.5 mm, about 2 mm, about 2.5 mm, about 3 mm, about 3.5 mm, about 4 mm, about 4.5 mm, about 5 mm, about 5.5 mm, about 6 mm, about 6.5 mm, about 7 mm, about 7.5 mm, about 8 mm, about 8.5 mm, about 9 mm, about 9.5 mm, about 10 mm, or more. In some examples, the hole 300 may have a diameter of about 3.5 mm.

As illustrated in FIG. 3, the hole 300 may have a depth (e.g., the distance from the edge of the half sphere 102 to the end of the hole 300). In some examples, the hole 300 may have a depth of about 1 mm, about 2 mm, about 3 mm, about 4 mm, about mm, about 6 mm, about 7 mm, about 8 mm, about 9 mm, about 10 mm, or more. In one example, the hole 300 may have a depth of about 5 mm. The hole 300 may allow a cylindrical object to be secured inside of it. In some examples, the cylindrical object may be a stick 600 for a lollipop, as illustrated for example in FIGS. 6 and 7. When the stick 600 is inserted in the hole 300 of the magic trick apparatus 100, the stick 600 and magic trick apparatus 100 may appear to be a lollipop to an observer. The stick 600 may have a length. In some examples, the stick 600 may have a length of about 50 mm to about 100 mm, about 100 mm to about 150 mm, about 150 mm to about 200 mm, or about 200 mm to about 250 mm. In an example, the stick 600 may fit into the hole 300 using a friction fit. The fit may be snug, such that the half sphere 102 may be swung around by a magician without the stick 600 coming out of the hole 300. In an example, the magician may twist the stick 600 in the hole 300 to secure the stick to the hole 300, and thereby secure the half sphere 102 to the stick 600. In some examples, the stick 600 may be attached to a candy end of a lollipop. In other examples, the stick 600 may not be attached to a candy end of a lollipop.

In some embodiments, the half sphere 102 may have a diameter of about 10 mm to about 30 mm. In some examples, the half sphere 102 may have a diameter of about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, about 24 mm, about 25 mm, about 26 mm, about 27 mm, about 28 mm, about 29 mm, about 30 mm, about 31 mm, about 32 mm, about 33 mm, about 34 mm, about 35 mm, about 36 mm, about 37 mm, about 38 mm, about 39 mm, about 40 mm, about 41 mm, about 42 mm, about 43 mm, about 44 mm, about 45 mm, about 46 mm, about 47 mm, about 48 mm, about 49 mm, about 50 mm, or more. In other examples, the half sphere 102 may have a diameter of about 10 mm to about 50 mm or about 50 mm to about 100 mm. In some examples, the half sphere may have a diameter of about 16 mm to about 18 mm, about 18 mm to about 20 mm, about 20 mm to about 22 mm, about 22 mm to about 24 mm, about 24 mm to about 26 mm, about 26 mm to about 28 mm, or about 28 mm to about 30 mm. In one example, the half sphere may have a diameter of about 21 mm to about 22 mm.

The coin 104 may be any circular shaped disk appropriately sized for matching the circumference of the flat surface 106 of the half sphere 102. Non-limiting examples of the coin may include US currency, such as a quarter, half dollar, nickel, etc., a foreign currency coin, a chip, such as a poker chip, a token, or a coin with no assigned value. The coin may have a diameter ranging from about 5 mm to about 100 mm. The coin 104 may be attached or connected to the flat surface 106 of the half sphere 102 by an adhesive or any mechanism operable to connect the two materials. In some examples, the adhesive may be glue or super glue.

Figure 4:
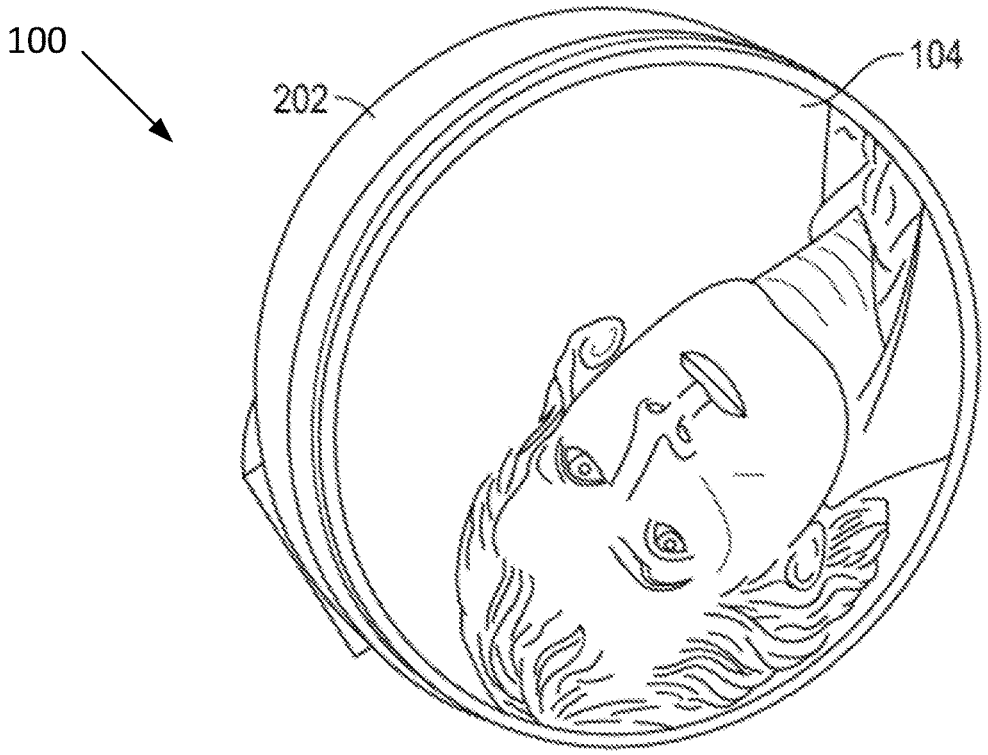
FIG. 4 shows a bottom view of a magic trick apparatus in one example.

As illustrated in FIG. 4, the coin 104 may be attached to the half sphere 102. The coin 104 may be any type of coin. For example, the coin may be a penny, nickel, dime, quarter or other U.S. currency coin. In one example, the coin may be a nickel. In other examples, the coin may be a euro series coin. For example, the coin may be a one cent euro coin, two cent euro coin, five cent euro coin, ten cent euro coin, twenty cent euro coin, fifty cent euro coin, one euro coin, or two euro coin. In further examples, the coin may be a British coin. For example, the coin may be a penny, ten pence, two pence, twenty pence, or other British coin. In other examples, the coin may be any other country's currency.

As illustrated in FIGS. 1 and 4, the coin 104 may have the same diameter as the half sphere 102. The coin 104 may be attached to the flat surface 106 of the half sphere 102 such that when the coin 104 is shown to an observer, the observer only sees the coin 104 and does not see the half sphere 102. In this way, the magic trick apparatus 100 may appear to an observer to just be a coin. When a magician rotates the magic trick apparatus 180 degrees, the coin 104 may be hidden from an observer, such that the magic trick apparatus 100 appears to an observer to be a lollipop (e.g., the half sphere 102).

In some embodiments, the half sphere 102 may be made out of a plastic. In some examples, the half sphere 102 may be made of a hard plastic. For example, the half sphere 102 may be made out of acrylic, polycarbonate, polyethylene, or other types of hard plastics known in the art. In another example, the half sphere 102 may be made out of any material that may appear to be a lollipop. In some examples, the half sphere 102 may be molded. In other examples, the half sphere 102 may be 3D printed.

In an embodiment, the half sphere 102 may be a solid color. For example, the half sphere 102 may be red, blue, green, yellow, orange, purple, white, or any other solid color. In other examples, the half sphere 102 may have multiple colors such as a rainbow or tie dye color. In further examples, the half sphere 102 may be any color or combination of colors. The half sphere 102 may be opaque such that an observer cannot see through it. In other examples, the half sphere 102 may be partially transparent. The half sphere 102 may be configured such that an observer cannot see the coin 104 on the flat surface 106 of the half sphere 102.

Further provided herein is a magic kit 500 for use in magic tricks. The magic kit 500 may include the magic trick apparatus 100 and a lollipop 520. The magic kit 500 may further include a container operable to hold the magic trick apparatus and the lollipop. In some examples, the container may be a box 502. In other examples, the container may be any type of container operable to hold the magic trick apparatus 100 and the lollipop 520.

Figure 5:
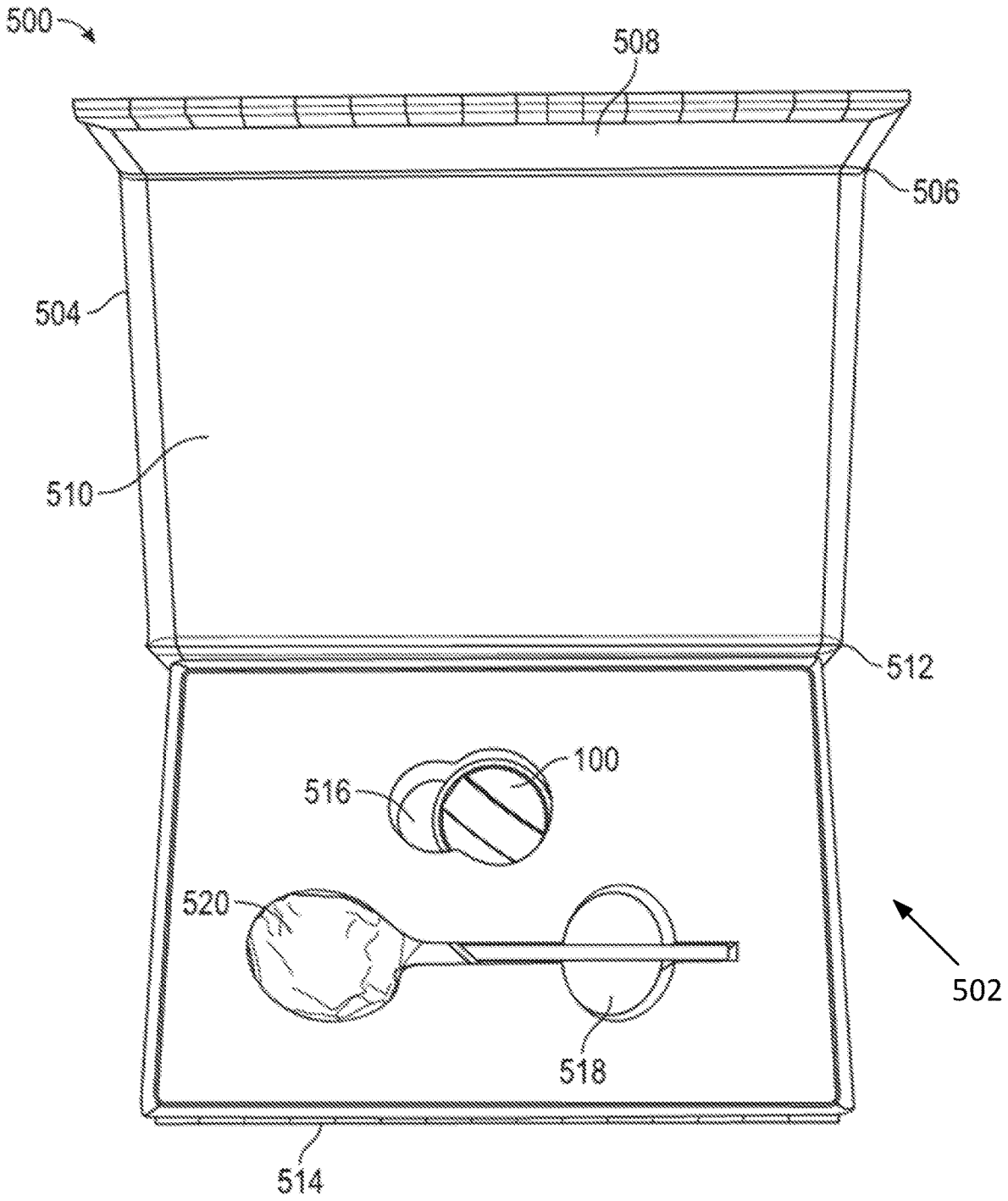
FIG. 5 shows an example of a magic trick kit having a magic trick apparatus and a lollipop in one example.

FIG. 5 illustrates an example magic kit 500. The magic kit 500 may include a box 502. The box 502 may have a first side 514, a second side, a third side, a fourth side, a bottom surface, and a lid 504. The lid 504 may extend from the third side (i.e., the side of the box 502 opposite the first side 514) and be configured to attach to the first side 514. In some examples, the lid 504 may be configured to enclose the box. The lid 504 may have a first fold 512, a second fold 506, a first portion 510, and a second portion 508. The first fold 512 may be attached to the third side of the box 502. The second fold 506 may be configured to enclose the box by extending from a top edge of first side 514 to the bottom edge of the first side 514. The first portion 510 of the lid 504 may be between the first fold 512 and the second fold 506 and may be configured to enclose the box 502. The second portion 508 of the lid 504 may be from the second fold 506 to an edge of the lid 504 (e.g., the edge of the lid 504 opposite the first fold 512). The second portion 508 of the lid 504 may be configured to removably couple to the first side 514. In some examples, the second portion 508 of the lid 504 may have a magnet inside of it. The first side 514 of the box 502 may have a magnet inside of it. The magnet in the second portion 508 of the lid 504 and the magnet of the first side 514 of the box 502 may have opposite polarities such that they may be removably coupled. In other examples, the first side 514 of the box 502 and the second portion 508 of the lid 504 may be configured to removably couple in other ways known in the art such as using Velcro, a snap fit arrangement, or other attachment means.

As illustrated in FIG. 5, the magic kit 500 may have a first slot 516 (e.g., chamber) and a second slot 518 (e.g., chamber). In some examples, the first slot 516 may be configured to hold the magic trick apparatus 100. The first slot 516 may hold the magic trick apparatus such that it does not fall out without providing some force from a user. The first slot 516 may have a portion operable for a user to insert a finger underneath the magic trick apparatus 100 to pull the magic trick apparatus 100 out of the first slot 516, as illustrated, for example, in FIG. 5. The second slot 518 may be configured to hold a lollipop 520. The second slot 518 may be configured to hold the lollipop 520 such that it does not fall out without providing some force from a user. The second slot 518 may have a long thin portion and two circular portions, as illustrated, for example, in FIG. 5. The long portion of the second slot 518 may be operable to hold the stick of the complete lollipop. Either circular portion of the second slot 518 may hold the candy end of the lollipop and the other circular portion be used by a user to pull the lollipop out of the second slot 518. In further examples, the magic kit 500 may have a third slot (not shown) configured to hold a loose coin. The loose coin may be identical or substantially the same as the coin 104 attached to the magic trick apparatus 100. For example, if the coin 104 on the magic trick apparatus 100 is a nickel the loose coin may be a nickel. The magic kit 500 may have a plurality of slots operable to hold one, two, three, four, five, six, seven, eight, nine, ten, or more lollipops. In other embodiments, the magic kit 500 may include a separate container with one or more lollipops.

In further embodiments, the magic kit 500 may be a bag configured to hold the magic trick apparatus 100 and the lollipop 520. It will be appreciated that other configurations of the container, box, or bag may be used to hold the magic trick apparatus 100 and the lollipop 520.

Figure 6:
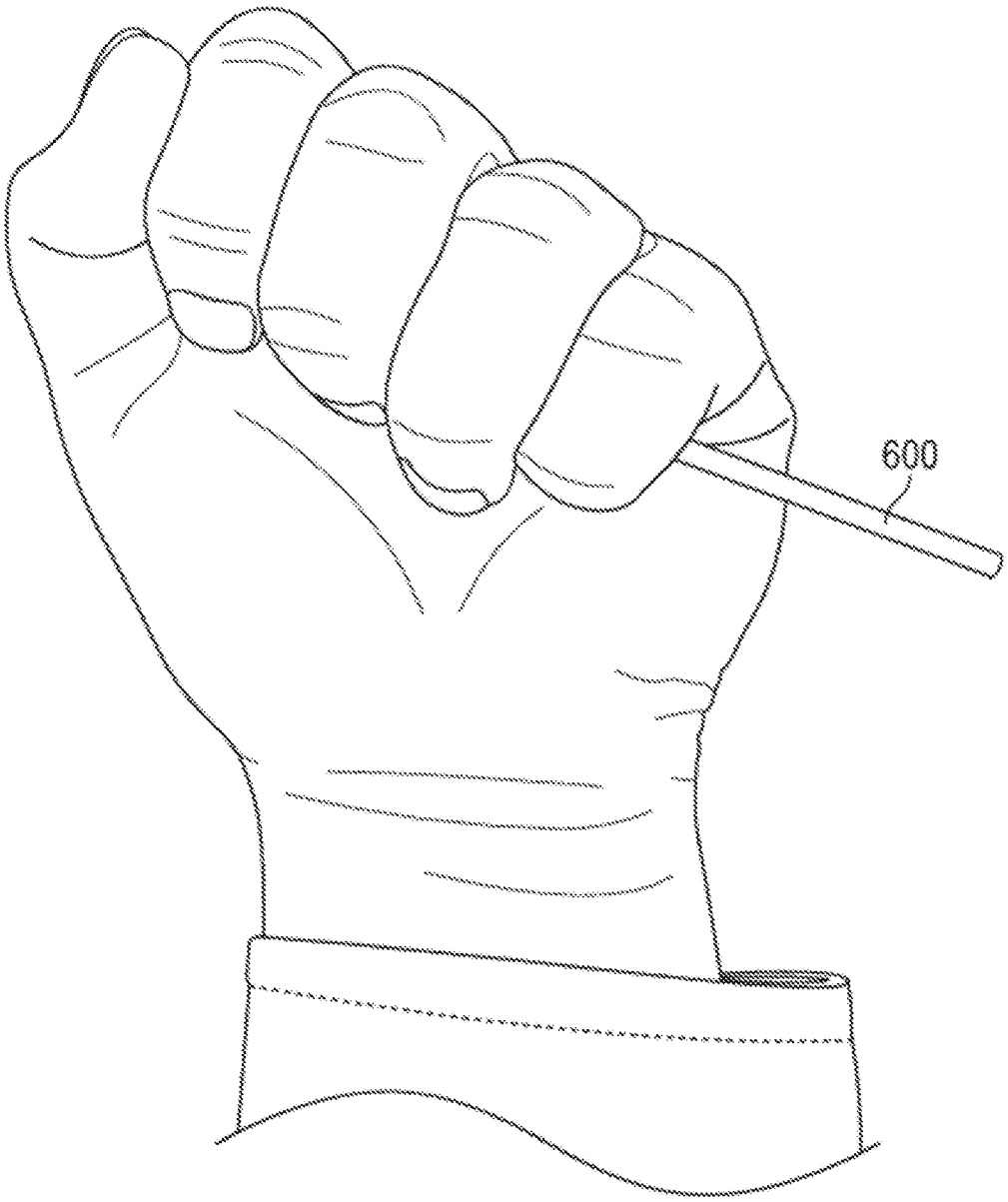
FIG. 6 shows a lollipop being held in one example.
Figure 7:
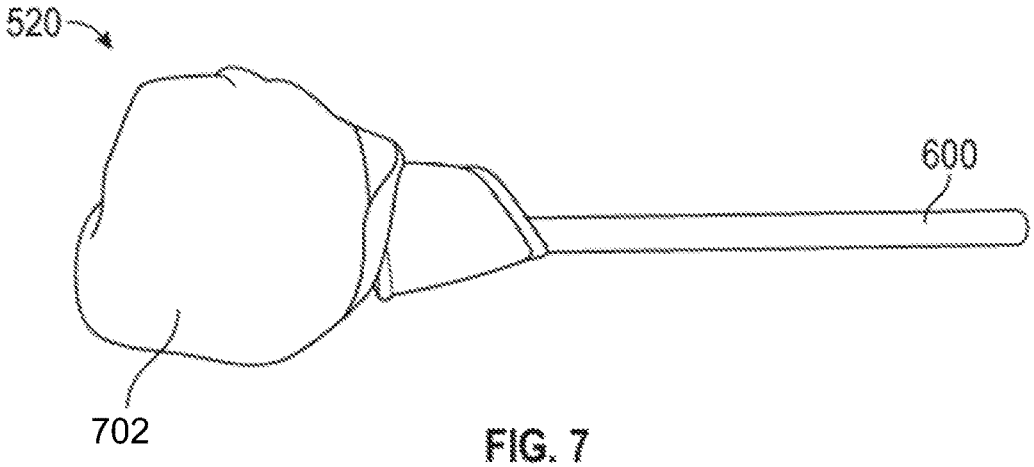
FIG. 7 shows a lollipop in one example.

As illustrated in FIGS. 6 and 7, the magic kit may include a lollipop 520. The lollipop may have a candy end 702 and a stick 600. The stick 600 of the lollipop may be operable to be inserted into the hole 300 of the magic trick apparatus 100. As illustrated in FIG. 6, the candy end 702 of the lollipop may be concealed within a hand of a magician. In some examples, as illustrated in FIG. 7, the candy end 702 of the lollipop 520 may be wrapped in a wrapper. The wrapper may be operable to cover the entirety of the candy end 702 of the lollipop 520. One benefit of the magic kit is that the lollipop 520 may be given away to an observer and a new lollipop may be placed in the magic kit. An observer may be surprised when they unwrap the lollipop and a realize the lollipop is a real lollipop that is edible.

In some embodiments, the half sphere 102 appears identical to a lollipop 520 for use in the magic trick. For example, the half sphere 102 may have the same size, shape, and color as the lollipop 520. The half sphere 102 may have the same size (e.g., dimensions) as a hemisphere of the lollipop 520 (e.g., a half of the lollipop 520). In another example, the lollipop 520 has a diameter of about 10 mm to about 50 mm and the half sphere 102 has a diameter of about 10 mm to about 50 mm. In an example, the lollipop 520 and the half sphere 102 are both red. In an example, if the half sphere 102 has a band 200, the lollipop 520 also has a band 200. In another example, if the half sphere 102 has a ridge 202, the lollipop 520 also has a ridge 202. In some examples, a half of the lollipop 520 looks identical to the half sphere 102.

In some embodiments, the lollipop may be a fake lollipop. The fake lollipop may be made out of the same material as the half sphere 102 and appear identical to the half sphere 102. The fake lollipop may be a full sphere that matches the appearance of the half sphere 102 (e.g., the fake lollipop may look like two half spheres put together). In some examples, the fake lollipop may have a hole operable to hold the stick 600. In other examples, the fake lollipop may be manufactured with a stick attached. In other examples, the fake lollipop may look identical or substantially the same as a real lollipop. In some examples, the fake lollipop may be wrapped or unwrapped. In some examples, the kit may include a lollipop 520, a fake lollipop, a half sphere 102, and a coin, or any combination thereof.

Figure 8:
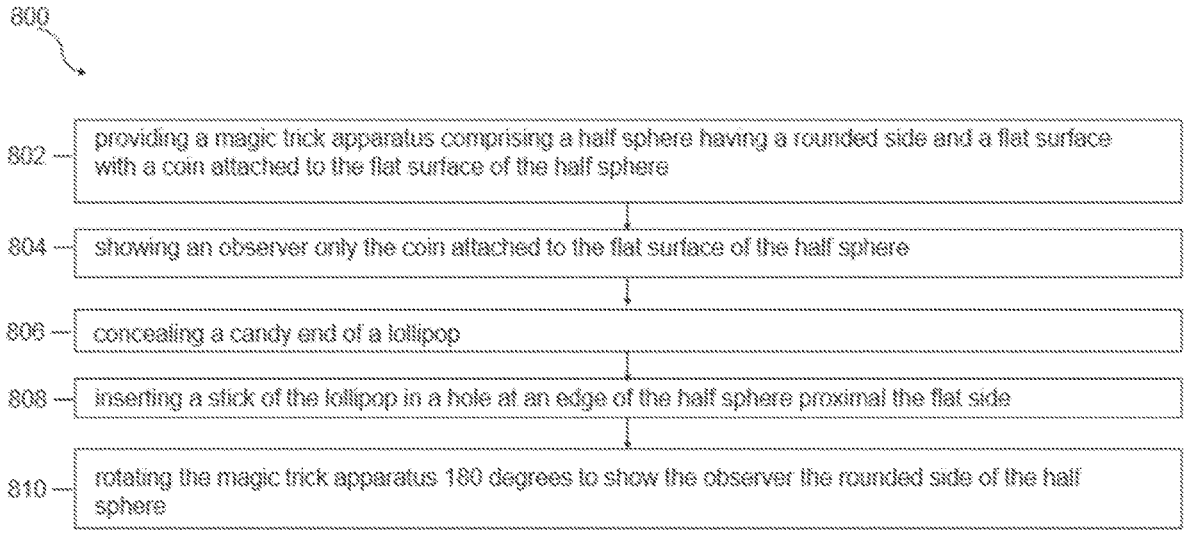
FIG. 8 is a flow chart of a method of performing a magic trick in one example.

Further provided herein are methods of performing a transformation of a coin to a lollipop, or vice versa. As illustrated in FIG. 8, a flowchart is presented in accordance with an example embodiment. The method 800 is provided by way of example, as there are a variety of ways to carry out the method. The method 800 described below may be carried out using the configurations illustrated in FIGS. 1-7, for example, and various elements are referenced in explaining example method 800. Each block shown in FIG. 8 represents one or more processes, methods, or subroutines, carried out in the example method 800. Furthermore, the illustrated order of the blocks is illustrative only and the order of the blocks can change according to the present disclosure. Additional blocks may be added, or fewer blocks may be utilized without departing from this disclosure.

The example method 800 is a method of transforming a coin into a lollipop using the magic trick apparatus. The example method 800 can begin at block 802. At block 802, the method includes providing a magic trick apparatus. The magic trick apparatus may be a half sphere having a rounded side and a flat surface. The flat surface may have a coin attached to it. In some examples, the rounded side of the half sphere may have a band running along a center axis of the rounded side. The rounded side may also have a ridge surrounding the circumference of the half sphere proximal the flat surface. The half-sphere may have a hole in the ridge operable to receive a cylindrical object such as a stick of a lollipop. The hole may be located perpendicular to the center axis.

In some embodiments, the method may include concealing the magic trick apparatus, the lollipop, and optionally a loose coin. In some examples, the magic trick apparatus, the lollipop, and the loose coin may be concealed in a magician's pocket or pockets. When the magician pulls the magic trick apparatus out of their pocket, the magician may locate the band of the magic trick apparatus with their hand. Locating the band of the magic trick apparatus allows the magician to know where the hole is in the magic trick apparatus. The hole may be located on either side of the band 90 degrees from the highest point of the band (e.g., the point of the band furthest away from the flat surface of the half sphere).

In some embodiments, the method may include showing a loose coin to an observer. The loose coin shown to the observer should match the coin on the magic trick apparatus. For example, if the magician shows a US nickel to an observer, a US nickel should also be attached to the flat surface of the half sphere of the magic trick apparatus. The loose coin may then be hidden from the observer.

At block 804, the coin attached to the flat surface of the half sphere is shown to the observer. When a loose coin is first shown to an observer, the loose coin may be hidden using sleight of hand such that the coin attached to the flat surface of the half sphere appears to an observer to be the same coin as the loose coin.

At block 806, a candy end of a lollipop is concealed. The lollipop may be produced from a pocket of the magician and the candy end may be concealed by the magician's hand as illustrated in FIG. 6. To maintain the surprise of the magic trick, it is important that the candy end of the lollipop is concealed.

At block 808, the stick of the lollipop may be inserted into a hole at an edge of the half sphere proximal the flat side of the half sphere. The stick may be inserted while maintaining concealment of the candy end of the lollipop. When the stick is inserted into the hole of the magic trick apparatus, the coin may appear to be attached to the stick.

At block 810, the stick of the lollipop may be rotated 180 degrees, thereby rotating the magic trick apparatus 180 degrees and revealing to an observer the rounded side of the half sphere. The entire lollipop is rotated by rotating the stick, but the candy end of the lollipop may remain concealed in the magician's hand. The coin may appear to an observer to transform into an unwrapped lollipop because the half sphere looks like a lollipop. The rotation may be completed using sleight of hand such that an observer does not realize that the magic trick apparatus and the stick were rotated at all.

In some embodiments, block 808 and block 810 may be reversed. For example, the magic trick apparatus may be flipped 180 degrees to transform the coin into a lollipop (e.g., the half sphere) and then the stick may be inserted into the hole of the magic trick apparatus.

In a further embodiment, once the observer is shown what appears to be an unwrapped lollipop (e.g., the half sphere attached to the stick of a real lollipop), the magician may transform the unwrapped lollipop into a wrapped lollipop. Using sleight of hand, the magic trick apparatus may be removed from the stick of the lollipop and the wrapped candy end of the complete lollipop may be shown to the observer. The magician may then hand the observer the complete wrapped lollipop. One benefit of the magic trick is that the observer may keep the lollipop. Most magic tricks do not allow the magician to give away one of their props at the end of the magic trick. However, the method provided herein allows a magician to give away a lollipop to the observer and allows the observer to enjoy the lollipop while the magician performs other magic tricks.

In another embodiment, the method may further include having the observer unwrap the lollipop to reveal a real lollipop. The observer may be surprised that the lollipop is a real lollipop, since originally all the magician had was a nickel. In some embodiments, the magician may give the observer the lollipop. The observer may then eat the lollipop or take the lollipop home as a souvenir.

In some examples, the steps of method 800 may be performed in reverse, such that the lollipop is "transformed" into a coin. In this example, the magic trick apparatus may be attached to a stick and the half sphere side may be shown to an observer. The magic trick apparatus may appear to be a lollipop. The magician may then use sleight of hand to remove the stick and rotate the magic trick apparatus to show the observer the coin attached to the flat surface of the magic trick apparatus. The magic trick apparatus may appear to transform from a lollipop to a coin. The magician may then use sleight of hand to replace the magic trick apparatus with a loose coin and provide the loose coin to the observer.

In some embodiments, the magician may use a fake lollipop instead of a real lollipop. The fake lollipop may have a hole operable to be inserted into a stick or may be manufactured with a stick. The fake lollipop may be used in the method for performing a magic trick as described herein. The fake lollipop may allow a magician to transform the coin on the magic trick apparatus to a full unwrapped or wrapped lollipop. The magician may conceal the fake lollipop. The magician may show the coin side of the magic trick apparatus to the observer, insert the stick into the hole of the magic trick apparatus, and rotate the magic trick apparatus 180 degrees to show the observer the rounded side of the magic trick apparatus (i.e., the side appearing to be a lollipop). The magician may then use sleight of hand to replace the magic trick apparatus with the fake lollipop by removing the stick from the hole of the magic trick apparatus and inserting the stick in the hole of the fake lollipop. Alternatively, if the fake lollipop is manufactured with a stick or already attached to the stick and concealed, the magician may show the fake lollipop to the observer by using sleight of hand to remove the magic trick apparatus from the stick and rotate the stick to show the fake lollipop to the observer. The fake lollipop may appear to be an unwrapped lollipop. In other examples, the fake lollipop may be wrapped in a wrapper and appear to be a full wrapped lollipop.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A magic trick apparatus, comprising:
a half sphere having a rounded side and a flat surface;
a hole extending into the rounded side of the half sphere located proximal the flat surface; and
a coin attached to the flat surface of the half sphere,
wherein the hole is operable to hold a stick.

2. The magic trick apparatus of claim 1, wherein the hole has a diameter of about 2 mm to about 5 mm.

3. The magic trick apparatus of claim 1, wherein the rounded side has a band projecting out from a surface of the rounded side.

4. The magic trick apparatus of claim 3, wherein the band is located along a center axis of the rounded side.

5. The magic trick apparatus of claim 1, further comprising a ridge projecting out from the rounded side and surrounding a circumference of the half sphere proximal the flat surface.

6. The magic trick apparatus of claim 1, wherein the half sphere comprises acrylic, polycarbonate, or polyethylene.

7. The magic trick apparatus of claim 1, wherein the coin is a US quarter, a US half dollar, a US nickel, a foreign currency coin, a chip, a token, or a coin with no assigned value.

8. A magic kit comprising:
a magic trick apparatus comprising:
a half sphere having a rounded side and a flat surface;
a hole extending into the rounded side of the half sphere located proximal the flat surface; and
a coin attached to the flat surface of the half sphere; and
a lollipop having a candy end and a stick.

9. The magic kit of claim 8, further comprising a container operable to hold the magic trick apparatus and the lollipop.

10. The magic kit of claim 8, wherein the hole has a diameter of about 2 mm to about 5 mm.

11. The magic kit of claim 8, wherein the magic trick apparatus further comprises a band projecting from the rounded side.

12. The magic kit of claim 8, wherein the magic trick apparatus further comprises a ridge surrounding a circumference of the half sphere proximal the flat surface.

13. The magic kit of claim 8, further comprising a loose coin.

14. The magic kit of claim 8, wherein the lollipop is a fake lollipop.

15. The magic kit of claim 8, wherein the lollipop is wrapped in a wrapper.

16. A method of transforming a coin into a lollipop, the method comprising:

providing a magic trick apparatus comprising:

a half sphere having a rounded side and a flat surface; and a coin attached to the flat surface of the half sphere;

showing an observer only the coin attached to the flat surface of the half sphere;

concealing a candy end of a lollipop;

inserting a stick of the lollipop in a hole at an edge of the rounded side proximal the flat surface of the magic trick apparatus; and rotating the magic trick apparatus 180 degrees to show the observer the rounded side of the half sphere.

17. The method of claim 16, the method further comprising:

concealing the magic trick apparatus; and removing the stick from the hole of the magic trick apparatus.

18. The method of claim 17, the method further comprising providing the lollipop to the observer.

19. The method of claim 16, wherein the half sphere has a band projecting from the rounded side along a center axis and a ridge projecting from the rounded side along a circumference of the half sphere.

20. The method of claim 16, the method further comprising:

showing the observer a loose coin identical to the coin attached to the flat surface of the half sphere prior to showing the observer the coin attached to the flat surface of the half sphere; and concealing the loose coin.

21. The method of claim 16, wherein the magic trick apparatus is rotated to the rounded side before inserting the stick of the lollipop into the hole of the magic trick apparatus.

22. The method of claim 16, further comprising giving the lollipop away to the observer.

23. The method of claim 22, wherein the lollipop is wrapped in a wrapper.

24. The method of claim 23, the method further comprising having the observer unwrap the lollipop.

* * * * *